United States Patent [19]

Comer

[11] 4,453,454

[45] Jun. 12, 1984

[54] MUD PUMP LINER AND PISTON CLEANER

[76] Inventor: Johnny Comer, 522 W. 6, Elk City, Okla. 73644

[21] Appl. No.: 442,708

[22] Filed: Nov. 18, 1982

[51] Int. Cl.[3] ..... F01B 31/00

[52] U.S. Cl. ..... 92/87; 92/86.5; 92/171

[58] Field of Search ..... 92/86.5, 87, 169, 171, 92/78, 153

[56] References Cited

U.S. PATENT DOCUMENTS 1,599,625 9/1926 Whitlock ..... 92/86.5

1,964,932 7/1934 Stoesling et al. ..... 92/87

*Primary Examiner*—Abraham Hershkovitz
*Assistant Examiner*—Scott L. Moritz
*Attorney, Agent, or Firm*—Robert K. Rhea

[57] ABSTRACT

In a mud pump liner and piston cleaner a split ring-type tubular reservoir, supplied with fluid under pressure, substantially surrounds the end portion of a liner projecting out of a mud pump cylinder. A plurality of small diameter tubing sections, each communicating at one end with the reservoir, direct streams of fluid, from their other ends, in a washing action toward the inner periphery of the liner.

3 Claims, 5 Drawing Figures

MUD PUMP LINER AND PISTON CLEANER

BACKGROUND OF THE INVENTION

1. Field of the invention.

The present invention relates to mud pumps of the triplex-type which are used in conjunction with a rotary oil well drilling operation to pump a mud mixture down through the drill pipe for removing drilled earth formations.

Pumps of this character have three cylinders in which each cylinder includes a piston reciprocated by a piston rod. The cylinder communicates with suction and discharge valve equipped chambers so that, as the piston is reciprocated by the piston rod, drilling fluid will be alternately drawn into and discharged from the working chambers. Since the material pumped is of an abrasive character, the wear on the piston and cylinder wall is quite severe and it has been common practice, in order to more easily repair a worn pump, to provide each cylinder with a replaceable steel liner which reciprocably supports the piston in the cylinder, however, as mentioned above, the abrasive drilling fluid results in a relatively short life for the liner and piston.

This invention tends to reduce the liner and piston wear by cleaning the liner and piston during pump operation.

2. Description of the prior art.

Prior patents generally relate to seals between the liner and cylinder walls and between the piston and liner in which the life of the seals is lengthened by forming fluid channels through the piston rod and piston between its end seals for conducting oil and/or water to lubricate the seals and reduce the abrasive action of the drilling mud particles.

This invention approaches the liner and piston wear problem from a different standpoint, namely, by washing drilling mud abrasive particles off the liner in the path of movement of the piston therein which is accomplished by providing conductors supported by the liner and applying streams of water to the bore of the liner and surface of the piston.

SUMMARY OF THE INVENTION

A split tubular ring, having closed ends, forms a fluid reservoir substantially surrounding the end portion of a pump liner projecting outwardly of the cylinder housing in the direction of the piston rod connected with the piston, the split ring being secured to the liner by set screws. A pump supplying a source of water is connected with the perimeter of the fluid reservoir. A plurality of tubes are connected in radially spaced relation at one end to the tubular ring with the other end of the tubes being open and turned inwardly toward the inner wall surface of the liner to direct a like plurality of streams of water impinging on the inner surface of the liner during operation of the piston.

The principal object of the invention is to provide a device for connection with a mud pump liner for directing streams of fluid against the inner surface of the liner for removing abrasive material clinging thereto and lengthen the life of the liner and its contained piston.

DESCRIPTION OF THE PREFERRED EMBODIMENT

Figure 1:
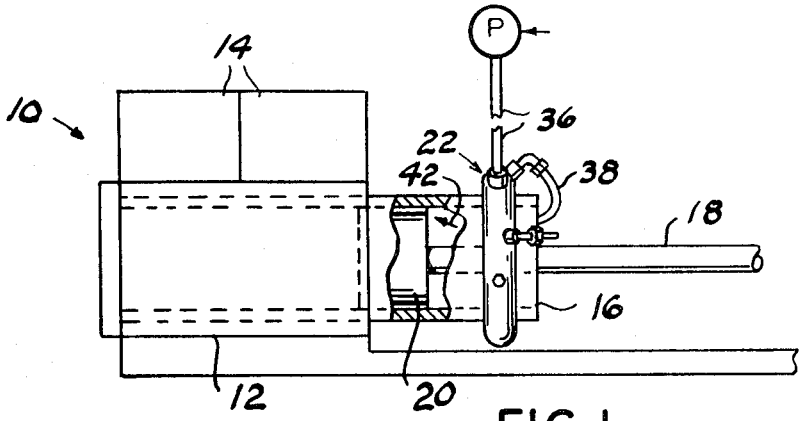
FIG. 1 is a mechanical diagram, partially in section, illustrating the liner cleaner in operative position.
Figure 3:
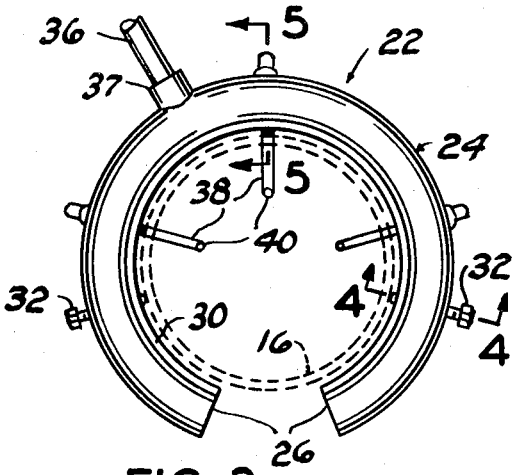
FIG. 3 is a left side elevational view of FIG. 2 illustrating, by dotted lines, the relative position of the liner; and, FIGS. 4 and 5 are cross sectional views, to a further enlarged scale, taken substantially along the lines 4—4 and 5—5 of FIG. 3.
Figure 2:
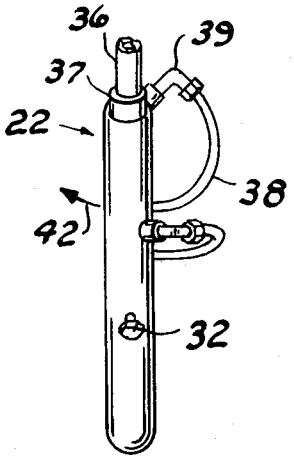
FIG. 2 is an edge elevational view, to a larger scale, of the cleaner, per se.
Figure 5:
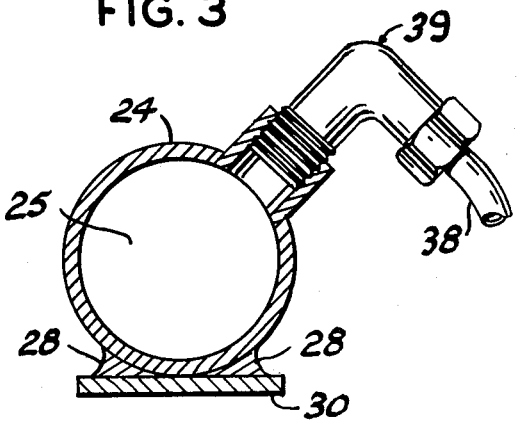
Figure 4:
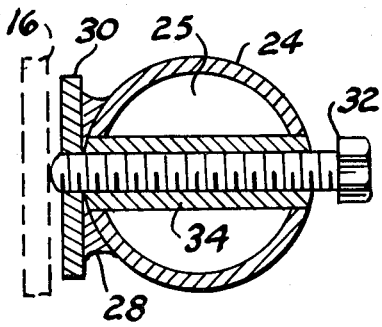

Like characters of reference designate like parts in those figures of the drawings in which they occur.

In the drawings:

The reference numeral 10 indicates a fragment of a triplex mud pump having a cylinder 12 communicating with valve equipped intake and exhaust chambers 14 in turn connected with mud supply lines, not shown. The cylinder is equipped with a sleeve-like liner 16 projecting at one open end outwardly of the cylinder in the direction of a piston rod 18 connected with a piston 20 for reciprocation in the liner 16 and pumping mud from a mud circulating pit to a drill string, neither of which are shown.

The numeral 22 indicates the device which is substantially coaxially mounted on the outwardly projecting end of the liner 16 adjacent its outwardly projecting end. The device 22 comprises a closed end length of tubing 24 of selected diameter forming a fluid reservoir 25. The tube 24 is arcuately curved in split ring fashion on a diameter slightly greater than the outside diameter of the liner 16 and having its respective closed ends 26 spacedapart a distance at least greater than the diameter of the piston rod 18. The inner perimeter of the tube 24 is rigidly secured, as by welding, indicated at 28, to a coextensive similarly arcuately curved section of strap metal 30.

A pair of set screws 32, each extending through a threaded sleeve 34 adjacent the closed ends of the tube 24, bear against the outer surface of the liner 16 to maintain the reservoir inner periphery substantially concentric with the liner.

An inlet line 36 is connected at one end by a collar 37 welded to the tube 24 for communication with the reservoir 25 and is connected at its other end with a pump P in turn connected with a source of water, not shown. A plurality, three in the example shown, of relatively small diameter tubes 38 are connected, at one end by fittings 39, and communicate with the reservoir 25 in circumferentially spaced relation. Each of the tubes 38 are arcuately curved toward the axis of the reservoir with their open ends 40 turned inwardly and directed toward the inner surface of the liner to apply a like plurality of streams of water under greater than atmospheric pressure, in the direction of the arrows 42, which wash abrasive particles off the inner surface of the liner.

Obviously the invention is susceptible to changes or alterations without defeating its practicability. Therefore, I do not wish to be confined to the preferred embodiment shown in the drawings and described herein.

I claim:

1. In combination with a mud pump having a cylinder and a liner therein projecting outwardly from one end of the cylinder and having a piston reciprocated in the liner by a piston rod, the improvement comprising:

reservoir means substantially surrounding said liner adjacent its outwardly projecting end, said reservoir means comprising an elongated closed end tubular reservoir arcuately curved throughout its length on a diameter greater than the outside diameter of said liner and having its closed ends disposed in spaced-apart relation a distance at least equal to the outside diameter of the piston rod;

pump means connected with said reservoir means for filling said reservoir means with fluid under greater than atmospheric pressure; and, tubing means connected with said reservoir means for directing at least one stream of fluid against the inner surface of said liner.

2. The combination according to claim 1 in which said tubing means includes:

a plurality of substantially equal length tubing sections of relatively small diameter when compared with the transverse dimension of said tubular reservoir; and, a like plurality of fitting means communicatingly connecting one end of the respective tubing section to said tubular reservoir in radially spaced relation, each said tubing section being arcuately curved at its other end portion toward the inner periphery of said liner.

3. The combination according to claim 2 and further including:

set screw means including set screws extending transversely through said tubular reservoir for maintaining said tubular reservoir substantially concentric with said liner.

* * * * *